United States Patent [19]

Jones

[11] Patent Number: 4,525,219

[45] Date of Patent: Jun. 25, 1985

[54] AMPULE CLEANING AND QUALITY CONTROL SYSTEM

[75] Inventor: Larry J. Jones, Overland Park, Kans.

[73] Assignee: Gard Corporation, Kansas City, Kans.

[21] Appl. No.: 483,521

[22] Filed: Apr. 11, 1983

[51] Int. Cl.[3] ..... B08B 3/12

[52] U.S. Cl. ..... 134/1; 73/577; 134/25.4; 134/184; 134/DIG. 1

[58] Field of Search ..... 134/1, 25.4, 184, DIG. 1; 53/425, 426; 141/83; 73/577

[56] References Cited

U.S. PATENT DOCUMENTS

| | | | |
|---|---|---|---|
| 2,814,575 | 11/1957 | Lange | 134/1 |
| 2,838,893 | 6/1958 | Sickel | 53/426 X |
| 2,994,332 | 8/1961 | Leonhardt | 134/184 |
| 3,071,497 | 1/1963 | Hinson | 134/1 |
| 3,302,655 | 2/1967 | Sasaki et al. | 134/1 X |
| 4,200,470 | 4/1980 | Pennekamp | 134/184 X |

*Primary Examiner*—Marc L. Caroff

*Attorney, Agent, or Firm*—Thomas M. Scofield

[57] ABSTRACT

Ampules may be cleaned and quality controlled by submerging frangible, sealed, partly filled, floatable ampules in a container in an ultrasonic cleaning tank bath in such manner as to not only clean all the ampules but also break a large portion of any flawed ampules, thereafter separating the intact ampules from the shattered ampules, collecting, washing, drying and packaging the former.

11 Claims, 8 Drawing Figures

AMPULE CLEANING AND QUALITY CONTROL SYSTEM

BACKGROUND OF THE INVENTION

Partially filled, liquid containing ampules are provided by the chemical and pharmaceutical industries in very great quantities. Typical contents of such ampules may include iodine, adhesive products, topical medications, smelling salts, other disinfectant liquids, perfumes, colognes and the like. Such ampules may be enclosed in a safety shield (i.e. plastic) sleeve with a porous, applicator tip or received in the handle of a pad type applicator. A moderate pinch on the sleeve or the applicator will break the ampule, permitting the product to flow through the applicator and be neatly dispensed. Many types of applicators have been designed around pinchable ampules. Adhesive products, topical medications, mailable perfume and cologne samplers and numerous other products have been adapted to such uses. Any liquid produce that flows freely and calls for protection, single use convenience and controlled, non-messy application typically may employ such ampules.

In typical ampule fabrication or formulation, the ampule container or vial, with an open top, is transmitted to a filling station to receive the desired quantity of filling product or liquid. Thereafter, the open filling end is closed and sealed. One such method of closing and sealing employs heating (by a gas flame) the open end of the ampule and pressing the heated glass upon itself while rotating the vial to make the end seal. In the steps of initial fabrication of the open end fillable vials, storage, handling, filling and sealing thereof, flaws and damage can occur to the structure. Specifically, for example, without limitation, in the glass itself, at any point, there may be weak points or stress cracks. In the original sealing of a first end of the vial, weakness, flaws, stress cracks and the like may be produced. Finally, in the final sealing after filling errors or flaws of material or process may cause the ampules to be of lesser strength and integrity than desired. Ampules may be closed by other means and methods.

Accordingly, manufacturers of these tiny containers, vials and ampules take steps to attempt to locate flaws in the ampules before such are packaged and shipped. Despite these processes and attempted safeguards, it is not at all unusual to have an approximate 5% breakage in transit, shipping and storage. This is quite objectionable.

In the process of inspection and testing, typical procedures might involve fluorescent dye tests to detect cracks and flaws in the glass and dropping test where ampules are dropped on metal plates to see if they will break. In the former case, the tests are time consuming and require special cleaning. Additionally, the fluorescent dye testing requires clear glass and this is not desirable in certain medicinal and drug applications where light may deteriorate the product. Thus, the dye tests find it difficult to detect cracks in brown or amber bottles which might give greater product protection against light. In the dropping tests, uniformity of results is difficult to obtain and the quantity of flawed vessels, vials or ampules which may be detected by this method is roughly approximately one half percent as opposed to the five or six percent (or greater) actually flawed. Clearly, various qualities of materials, methods of manufacture, methods of filling, sealing and handling may vary the quantity of flawing for given vials and products.

Additionally, after filling and sealing, it is almost universally necessary that effective cleaning processes be applied to vials and ampules before they are packed and passed into commerce.

In a typical prior art usage involving a large production flow through of individual small ampule containers, a number of stations, say four, each with a sink for an initial water bath, are provided, with two people at each side. The vials or ampules come from the filling and sealing process and are dumped into the sinks in a soap and water mixture. They are moved around in this mixture by the people at the sink and then lifted out and put into a separate rinse tank. Since the vials or ampules are only partially filled and, further, sealed, they normally and naturally float with the filled end down and the opposite, empty, air or gas filled end up. Full submergence in cleaning and rinsing is required.

From the rinse tank, the vials are typically transferred to large area tubes having paper towels thereon. Because of the problem of ampule integrity, there is additionally provided on each of these tables a metal sheet, on which hand full of vials and ampules are dropped. A certain percentage break. Then the intact vials are taken through a second drying step and passed into a storage basket before packaging. With this process, as previously mentioned, approximately one half of one percent of the total ampules are broken, but an additional five percent will break in shipment, which is very objectionable. Thus it may be seen that this is not an effective mode of both cleaning and quality controlling the sealed vials.

BRIEF DESCRIPTION OF THE INVENTION

A container is provided which will receive a large number of the filled ampules which are to be cleaned and quality control screen or sifted. This container is adapted to be received in an ultrasonic cleaning bath tank holding a single layer of ampules submerged beneath the liquid of the bath tank. Ultrasonic energy is transmitted into a bath in such quantity and in such mode as to both clean the ampules within the container and submit them to sufficient vibrational stress in the liquid medium so as to break a substantial percentage of any flawed ampules in the container.

During the process of cleaning and vibrational stressing of the ampules, flawed ampules will break and thus lose their seal and sink within the container to be caught by the bottom wall thereof. The container must be of such character as to be permeable and fillable by the ultrasonic cleaning bath liquid yet also be so constructed as to effectively transmit the vibrational energy of the bath into and through the containers and into the ampules.

Once the ampules have been cleaned and sifted by energy stress of flawed ampules, it is necessary to separate the cleaned containers from the broken ampules in the containers and pass them on to storage or packaging after drying.

In order to accomplish the latter in most efficient fashion, the container or basket with the ultrasonic bath processed ampules is removed into a second tank, this being a rinse tank. In this rinse tank, there is provided a one directional flow of liquid. The top and one side of the container, in the direction of flow of the liquid, are lifted or removed, allowing the intact ampules to float upwardly to the surface of the rinse tank bath, and be collected by movement controlling baffles and picked up on a carrier conveyor belt. Thereafter, they are passed to a drying step and then into a collecting container before packaging.

By virtue of this improved apparatus and process for cleaning and stressing the ampules in the cleaning step, in a specific application, the five percent flawed container breakage is achieved within the cleaning bath and only approximately one half percent of the intact surviving ampules have been found subject to breakage. Thus, the undesirable breakage figures of the conventional processes have essentially been reversed to advantage.

OBJECTS OF THE INVENTION

The first object of the invention is to provide new means of and methods for cleaning sealed, partly filled, floatable ampules in an effective manner. Such cleaning method, as well as the rinsing and further processing steps, are adaptable to both frangible and nonfrangible ampules.

Another object of the invention is to provide new methods of and apparatus for both cleaning and quality control sifting of frangibles, sealed, partially filled and floatable ampules wherein a substantial proportion of any flawed ampules, if present in those being cleaned, rinsed and dried, are broken or destroyed whereby to separate them from the intact and properly constructed ampules.

A further object of the invention is to provide improved methods of and apparatus for handling a large number of floatable, sealed, partly filled ampules in both an ultrasonic cleaning bath and a following rinse bath so that both cleaning of the ampules and quality control segregation thereof, if the ampules are frangible, efficiently take place.

Another object of the invention is to provide a new container for handling floatable ampules which is useable both in the ultrasonic cleaning bath and the rinse bath in new and optimal modes for handling, cleaning and quality control sifting of floatable, sealed and partly filled ampules of various sizes.

Other and further objects of the invention will appear in the course of the following description thereof.

THE DRAWINGS

In the drawings, which form a part of the instant specification and are to be read in conjunction therewith, embodiments of the invention are shown and, in the various views, like numerals are employed to indicate like parts.

FIG. 1 is a three-quarter perspective view, from the front and above of the improved container for receiving, holding and releasing ampules in the subject inventive process. In this view, the top of the container is shown raised as it would be in the second stage of the process, specifically, in the rinse tank bath following the ultrasonic cleaning bath. The dotted line showing is the closed top position.

FIG. 2 is an enlarged view of a typical sealed, partly filled, floatable, frangible (glass) ampule which is one subject of the instant improved cleaning and quality control sifting process. This ampule is shown in near floating position (empty end up) substantially as such would appear in both the ultrasonic cleaning tank bath and rinse bath following same.

FIG. 3 is a side view of apparatus, schematically shown, wherein the subject inventive process may be carried out. In the views, parts are shown cut away to better illustrate the individual structures of the particular devices. From left to right, the elements of the apparatus comprise: the ultrasonic cleaning tank, the rinse tank, the drying step and the collection step.

STRUCTURE AND FUNCTION

Figure 1:
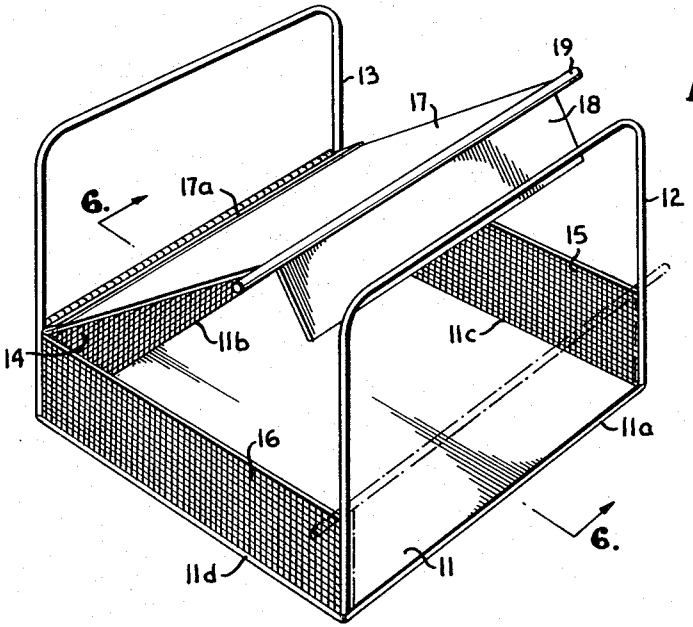

Ultrasonic cleaning is accomplished through a phenomenon called cavitation which is the implosion of small vapor bubbles induced in a cleaning solution by high intensity sound waves. The sound waves generate alternately high and low pressure conditions in the cleaning solution. On the low pressure side of such alternating cycle, pressure is reduced to less than the vapor pressure of the liquid, thus forming microscopic voids or bubbles. A half cycle later, the pressure in this same zone becomes positive and the vapor bubbles implode. It is such cavitations, with the accompanying pressure and heat at each implosive location, that creates the "scrubbing" action in an ultrasonic cleaning unit. This action, in conjunction with the proper cleaning solution, provides a highly efficient cleaning method.

The sound waves which initiate cavitation are typically generated by first converting sixty Hertz electrical energy to high frequency electrical energy through rectifier/inverter circuitry. The high frequency electrical energy is then used to drive transducer elements. The transducer elements convert the high frequency electrical energy to mechanical vibrations, thus generating sound waves in the solution.

Transducerized tanks are fabricated, typically, from suitable stainless steel, with all-welded, crevice-free construction, preventing entrapment of containments and providing chemical capability with the most frequently used chemical agents. Standard available tank sizes range in capacity from 1.5 gallons to 156 gallons and in power ratings from 200 to 6,000 watts.

Most tanks are available in either medium power density (five watts per square inch) or high power density (ten watts per square inch). Generally, high power density units are used for the more difficult ultrasonic cleaning applications where parts are massive in size or where production volume requires faster cleaning.

Transducerized tanks can be supplied with heaters for quickly elevating and maintaining solution temperature. Heated tanks through the 12 gallon capacity models typically utilize strip heaters mounted to the outer wall of the tank with an external shroud enclosing the heaters. Larger size tanks may be of single wall construction with stainless steel, immersion heaters available as an option. All such heaters are typically thermostatically controlled.

The previously given background information on ultrasonic cleaning apparatus and process was derived from the Westinghouse Electric Corporation Industrial Equipment Division Process Equipment Department of Sykesville, Md., 21784 Descriptive Bulletin 80-359 "Ultrasonic Cleaning Equipment". This bulletin gives information on tanks, transducers and generators. A typical useable tank in the application to be herebelow described is a Westinghouse Magnapak Transducerized Tank (T-Series) of high power density (10 watts/square inch). More specifically, model T3K394HI (having an ultrasonic power in watts of 3,000, a 39.4 gallon capacity, inside tank dimensions of 23 inches length, 19 inches width and 22 inches depth) has proven satisfactory. This tank includes a five kilowatt heater and has an approximate shipping weight of 240 pounds. Such tank is schematically inidcated at the left in FIGS. 3 and 5.

Figure 2:
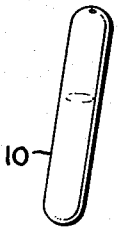
Figure 6:
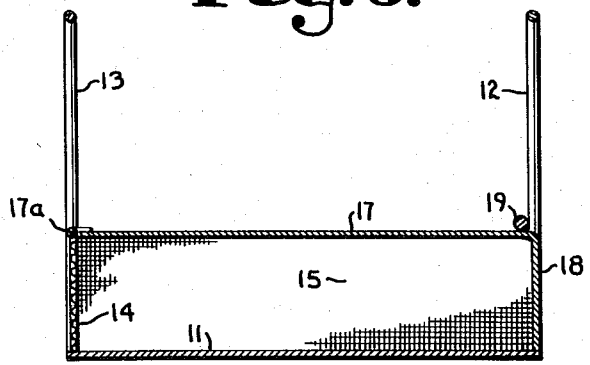
FIG. 6 is a view taken along the line 6—6 of FIG. 1 in the direction of the arrows with the top of the basket or container closed.

Turning first to FIGS. 1 and 6, therein is shown a container developed for receiving, holding and handling ampules of the type seen at 10 in FIG. 2 in the cleaning, quality control sifting and rinsing stages of the process to be described. This container or basket is preferably square or rectangular in vertical plan and has a flat, solid metal floor 11, preferably of stainless steel sheet. Floor 11 has front edge 11*a* and rear edge 11*b*, as well as side edges 11*c* and 11*d*. Welded or otherwise fixedly attached to front and rear edges 11*a* and 11*b* in floor 11 are two wire rod grasping handles 12 and 13, respectively. These are of inverted, square U-form and are of sufficient length so as to extend well above the surface of the liquid (and preferably the top edge of the ultrasonic cleaning and rinse tank) for easy grasping and handling of the basket. The lower ends of handles 12 and 13 are welded, or otherwise fixedly attached, to floor 11.

Rear end wall 14 is of stainless steel mesh, as are side walls 15 and 16. These walls are a number of inches high and have parallel top edges to the flat floor 11. Walls 14–16, inclusive are integrally fixed at their lower edges to floor 11 and at their end edges to the handles 12 and 13. There is no front wall to the basket, this being provided by an extension from the top wall to be described.

The top wall comprises an elongate flat, solid metal sheet 17 which is hingedly mounted at 17*a* at the top of rear wall 14 and with respect to handle 13. Fixed at right angles to the front end of top wall 17 is front wall closure 18 which, as can be best seen in FIG. 6, operates to close the front wall and make an integral, sealing closure of the container or basket when the top wall is down. An elongate rod 19 is provided to be engageable by flanges or members in the rinse tank at the sides thereof to hold the top up in the position of FIGS. 1 and 3 (in the rinse tank) so the ampules can escape from the basket or container. In normal closed position, as is seen in dotted lines in FIG. 1 and full lines in FIG. 6, rod 19 overlies the top edges of walls 15 and 16 while the bottom edge of front closure wall 18 is in contact with the top surface of bottom wall 11.

The purpose of the solid bottom wall 11 is to transmit ultrasonic energy with a maximum efficiency into the container or basket itself from the driven bottom wall of the ultrasonic cleaning bath. This wall must also catch and hold parts of broken ampules. Wall 11 is preferably placed (in the bath) at a height where the standing wave of energy created in the ultrasonic cleaning tank finds the bottom wall at a nodal position for maximum energy transmission into the basket. The purpose of the solid top wall is to hold down the ampules when placed in the basket and also reflect the sound energy of the ultrasonic vibrations back into the container. The solid front closure wall 18 makes a solid closure and a strong attachment to wall 17. The wire mesh walls 14–16, inclusive are for the purpose of admitting the liquid of the ultrasonic cleaning bath into the container or basket for cleaning purposes.

Figure 3:
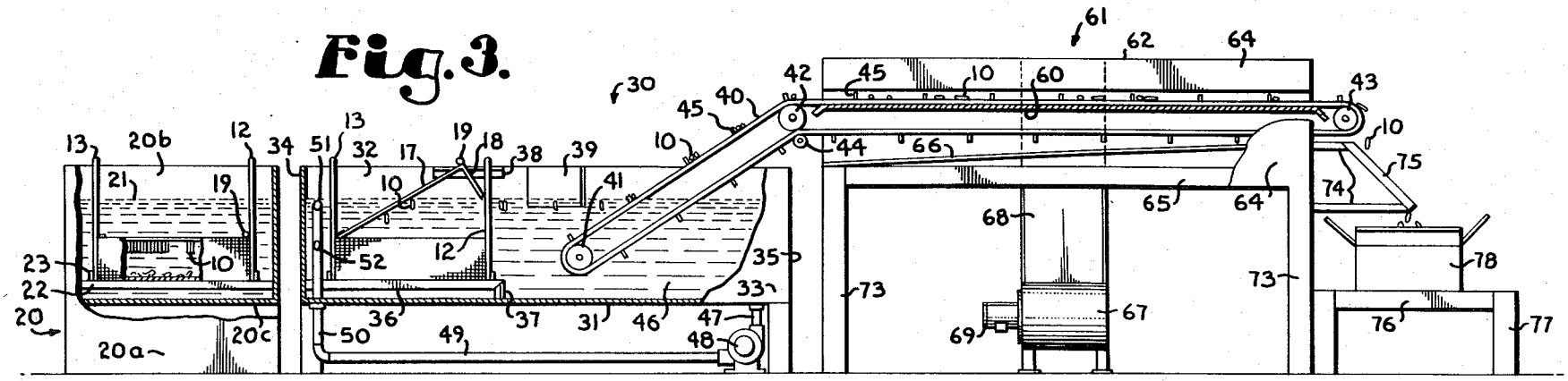
Figure 5:
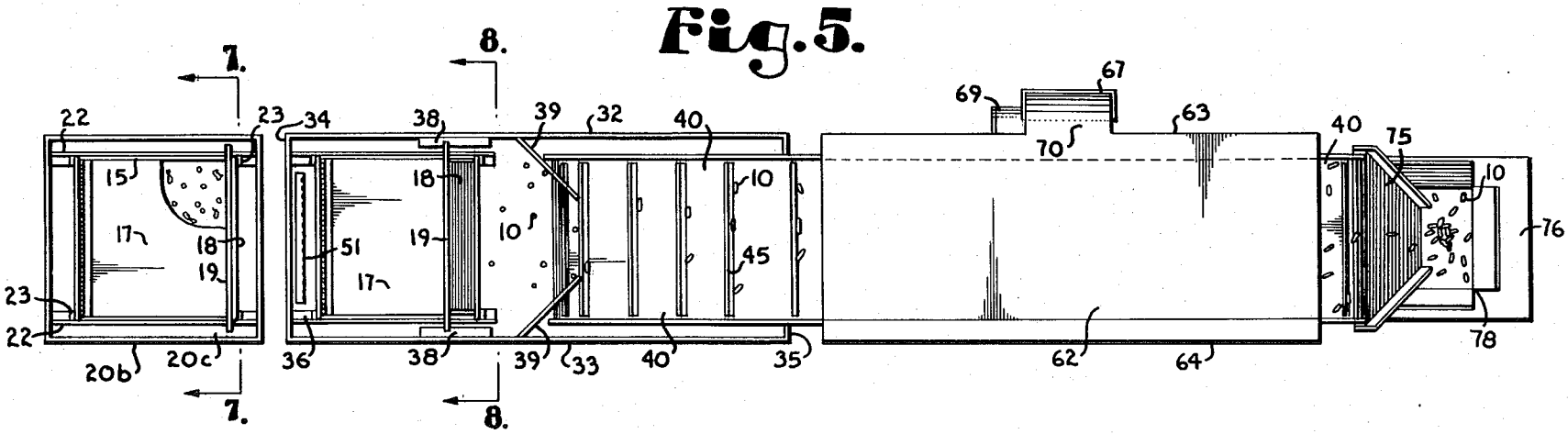
FIG. 5 is a top view of the apparatus of FIG. 3. Part of the container holding the ampules is cut away in the left hand portion of the view to better illustrate the construction.

Referring to FIGS. 3 and 5, particularly, at 20 is schematically designated an ultrasonic generator cleaning tank bath of the character described. This has a base 20*a* having the power unit therein and a tank formed of side walls 20*b* and power generating bottom wall 20*c*. A liquid body 21 is provided of suitable cleaning liquid in the bath.

Figure 7:
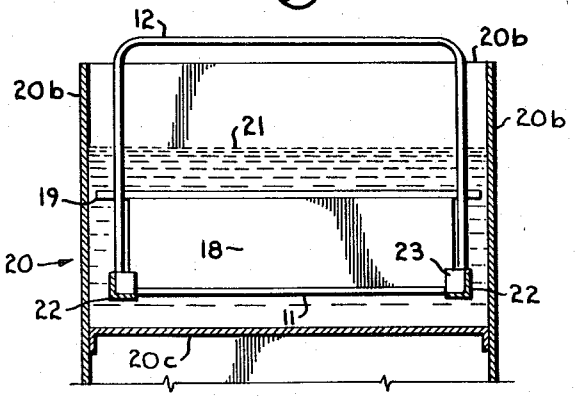
FIG. 7 is a view taken along the line 7—7 of FIG. 5 in the direction of the arrows.
Figure 8:
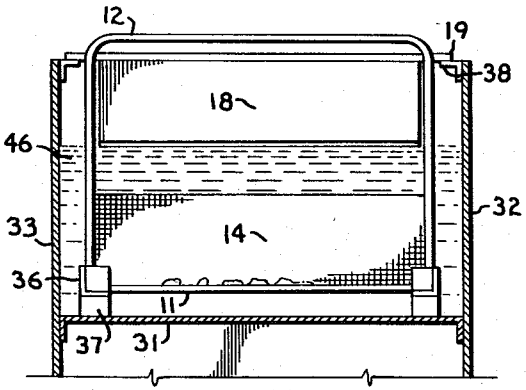
FIG. 8 is a view taken along line 8—8 of FIG. 5 in the direction of the arrows.

In order to receive the basket or container of FIGS. 1 and 6 in proper holding fashion during ultrasonic cleaning, angle irons 22 (FIG. 7) are provided, such welded or otherwise fixedly attached to opposed walls in the ath. Stops 23 are provided fore and aft on the angle irons to provide fore and aft stability as well as side stability, the latter provided by the angle irons. In the operation of the device it is absolutely necessary that the entire container (save for handles 12 and 13) be submerged in the bath so that the ampules 10 are floated by their own buoyancy against the top 17 of the basket.

The ultrasonic cleaning bath being a discrete step in the ampule handling process, its functions will now be described. It is important to realize that the basic function and use involved in the ultrasonic tank 20 is the cleaning of the ampules. The fact that this use in the container or basket employed also gives a quality control effect with frangible capsules or ampules (in that the energy of the ultrasonic cleaning will break faultily sealed ampules) is, in a sense, a bonus. It is perhaps an artifact of a given closure or sealing process that leads to so many flawed ampules. This should be additionally said with respect to the fabrication methods of the basic vial (before filling) which becomes the sealed, closed ampule. That is, better manufacturing and sealing processes might reduce the necessity of the specific quality control. However, as previously mentioned, using the subject system and apparatus, now some five percent of the ampules presented from the filling process are shattered in the ultrasonic cleaning tank and there is only one half of one percent breakage in shipment. This comprises a reversal of the previous manual quality control situation figures and is much more acceptable in the marketplace.

In the process of ultrasonic cleaning, there is provided a standing wave in the liquid of the tank produced by the vibration of the bottom wall 20*c* of the tank. There are nodal points vertically spaced therefrom at about one and a half inches apart. The bottom of the basket is placed (by virtue of the placement of the I beams 22) at one of the nodal zones which represent the highest concentrations of energy. Specifically, that is, there is 100% available energy at the nodes and a lesser, say 80%, energy concentration available therebetween.

As noted with respect to the basket, the bottom wall and the entire top wall are preferably solid, stainless steel. The bottom wall is solid for two reasons. The first is to receive and pass on (reflect on) the ultrasonic energy. The second reason for solidity is to catch and retain all of the shattered glass of the broken, flawed ampules. If bottom wall 11 were not solid, rather a mesh, it would tend to absorb the ultrasonic energy and not transmit such efficiently on into the container and to the ampules.

No more than one layer of ampules is preferably received within the basket or container and such is held down in the basket by the solid top. There is no attempt to place the top at a nodal point because the ultrasonic energy generated by bottom wall 20*c* is pretty well broken up by the bottom wall 11 of the basket.

A typical energy imput to the ultrasonic bath would be 18,000 to 20,000 cycles per minute at an energy level of 10 watts per square inch. This power generated into the basket for approximately two minutes (in a specific case) has proven to break down the desired percentage of the ampules. Two minutes ultrasonic operation time of the bath will cause such breakage and, further, efficiently, effectively and fully clean the ampules. More ampules will break over an increased time at this energy level, but the percentage broken drops very quickly. Thus, it is believed that adequate quality control is effected in the two minute intervals, as well as sufficiently effective cleaning. The ultrasonic cleaning bath is maintained at 100° F. in order to aid the cleaning. A chemical cleaner may be employed unless the impurities are water soluble. Intensity of power applied and time of application, etc. may vary according to the strength and nature of the ampules.

Referring now to the left center of FIGS. 3 and 5, therein is seen the rinse tank, generally designated 30. Tank 30 has bottom wall 31, side walls 32 and 33 and end walls 34 and 35. In the direction of procedure of the process, end wall 35 is a forward wall and end wall 34 is the rear wall. Angle irons 36 with (unnumbered) stops thereon are provided in the same manner as in tank 20 but anchored to rear wall 34 and with supports 37 on the forward ends thereof. The purpose, again, is to solidly and securely receive thereon the basket with the ampules therein. Beams or flanges 38 are provided along the sides 32 and 33 of tank 30 in order to catch the ends of rod 19 and hold the top 17 in the elevated position seen in FIGS. 1 and 3. Converging, ampule controlling baffles 39 are provided downstream or forward of the basket position in tank 30 to cause the floating ampules rising out of the container to converge centrally. Thereafter, such are placed up on conveyor belt 40 which is received on and over conventional rollers 41, 42 and 43, there being additional suitable positioning rollers as at 44 provided where the belt changes direction or elevation. Rollers 41–44, inclusive are mounted on and driven by suitable conventional shafts and power sources, not shown or here described. Transverse flanges or cleats 45 are provided on belt 40 in order to provide positive pickup of the ampules from the surface of liquid body 46 in the rinse tank.

It should be noted that the conveyor belt 49 in its rearmost position is extended well under the surface of the liquid 46 in tank 30 and rearward of the foremost ends of baffles 39. The rinse liquid, which may be water, is taken off centrally at the forward bottom end of tank 30 through pipe 47, driven by pump 48 and passed rearwardly through pipe 49 to vertical standing pipe 50. The latter is connected to manifolds 51 and 52 which are positioned at right angles to pipe 50 and serve to direct jets of the recycled rinse tank liquid laterally forwardly) and upwardly (in the case of manifold 52) in order to cause a continuous current of water moving from left to right in the views of FIGS. 3 and 5. Such moves the ampules up out of the container and to the right in the view to baffles 39 and then onto the conveyor belt 40.

Thus it may be seen there is a recycle circulation, on a continuous basis, of the rinse stage or tank liquid which, typically and optimally, may be 120°F. to 180° F. water. This heat helps to dry the capsules when they are removed from the rinse bath. The takeoff 47 from the right hand central bottom of tank 30 recycles the tank liquid into the two perforated manifolds 51 and 52. The lower manifold jets the liquid upwardly to aid in removing the ampules from the basket. Ampules 10, which stand essentially vertically in the liquid at all times, move along the inclined underside of top 17 until they reach the surface of the liquid 46 in tank 30. Front wall 18 of the basket is preferably lifted sufficiently high that the ampules can readily move under its lower edge and out of the basket toward baffles 39. The jets from the upper manifold move the water to the right toward the conveyor along the surface thereof. As the ampules pass between baffles 39, they are centered in the tank and passed over conveyor belt 40 where they are picked up, if not by the belt, by cleats 35 thereon. Further secondary baffles (not seen) may be provided along the conveyor if necessary or desired.

The conveyor belt and frame structure (the latter schematically designated at 60) passes through a heating or drying zone generally designated 61. This drying zone 61 essentially comprises a substantially enclosed hollow tunnel through which the conveyor belt travels in a horizontal orientation. The top wall 62 has depending top side walls 63 and 64 therefrom. These walls extend vertically downwardly to the base or floor 65 of the tunnel or housing and thus provide a substantially complete, hollow, floored, roofed and side wall enclosing tunnel for the said conveyor belt. An intermediate height inclined floor 66 may alternatively be provided so that any ampules which fall off the conveyor will collect down at the left hand end of the tunnel and may be recovered.

Figure 4:
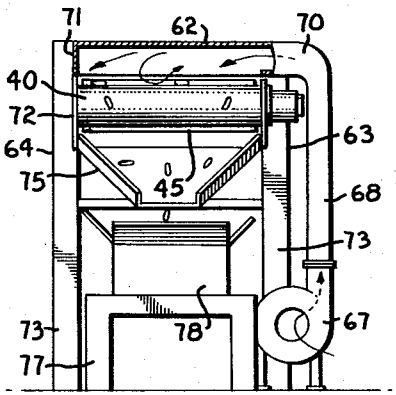
FIG. 4 is an end view of the apparatus of FIG. 3 taken from the right hand side of the view of FIG. 3 looking to the left in the view. A portion of the apparatus is cut away to better show the construction thereof.

A blower 67 is provided on one side of the heating tunnel (or drying step) 61 with the output therefrom passing into vertical duct 68. Motor 69 drives blower 67 and conventional heating elements (not shown), optionally electrical strip or electrical grid, are provided in duct 68 before its upper end discharge 70 into the top hood portion of the tunnel over the conveyor belt 40. In addition to the outer walls 63 and 64, suitable reflector walls such as are seen at 71 and 72 (FIG. 4) may be provided to retain the heated air passing from the blower outlet 70 within the plenum or chamber under top 62 and between outer walls 63 and 64. The object of these constructions, as well as the enclosure of the tunnel is to maintain the hot air in the tunnel, drying the ampules as long as possible with passage out of the somewhat heat exchanged or cooled air only at the ends of said tunnel. Legs 73 support the housing which encloses conveyor belt 40.

At the discharge end of the drying unit 61, there is provided, on a frame 74, a downwardly inclined and inwardly converging tray or trough 75 which receives the cleaned, stress tested and dried ampules 10 from the conveyor belt.

In the termination shown for the illustrated process, a table or platform 76 supported by legs 77 carries container 78 thereon adapted to receive the processed ampules therein for transfer to the automatic packing, etc. machines.

In order to give a rough idea of the scale of the illustrated operation, which is schematically shown, the distance from the left hand end of ultrasonic cleaner tank 20 in FIG. 3 to the right hand end of platform 76 could be approximately 18 feet. The height of top 62 of the heating or drying unit 61 from ground level would be approximately four feet. The drying unit from wall 63 to wall 64 could be approximately 2 feet 6 inches wide.

To base a comparison of the logistics of the illustrated and described process (that of FIGS. 3–5, inclusive) the subject development would typically involve one worker at the load station, one worker at the unload station, a processing rate of 500,000 ampules per day, 5% destructed structurally rejected ampules and less than 0.1% failure of ampules in transit.

The previous process over which this development improves, basically manual cleaning as opposed to the semi-automated process of this application, would involve four stations with two people at each station for a total of eight. 300,000 ampules could be processed per day. Up to 1% of the ampules processed would be rejected from drop impact failure on the metal plate previously mentioned. In transit and packaging, a 5% failure of all ampules was experienced.

The estimated savings using the subject process and apparatus is approximately $800,000 per year for but a single installation.

Details with respect to particular usage and application of the systems shown and described include the following. In the ultrasonic cleaning tank, 50 gallons may be employed with electric heating to 100° F. Typically, a mild detergent may be employed in water or water alone if the impurities are water soluble.

In the rinse stage at 30, the tank typically holds 150 gallons of water and is electrically heated to 120° F. to 180° F., A conventional wetting agent may be added to the water to aid drying. In the dryer stage 61, by electrical heat elements in duct 68, heated air is provided in the range of 120° to 160° F.

This apparatus and process is adaptable to the cleaning and quality control sifting of submerging ampules as well as floating ampules. In such case, the ampules are subjected to the ultrasonic vibration while they are in contact with the bottom floor 11 of the container. It has been discovered that the vibration transmitted by the bottom wall 11 of the container does not threaten the integrity of nonflawed capsules or ampules. The stressing of the ampules results in the same sieving or sifting effect on a quality control basis as for floated capsules. In all cases, of course, the energy of the bath must be gauged to the strength of the ampule.

However, the impact capsules, after ultrasonic cleaning and treatment lie in the debris of the broken capsules. The container is then lifted and carried into a rinse tank which is analogous to that shown in the figures. After suitable rinsing by liquid current moving, the container is removed from the bath and the intact ampules may be hand separated from the debris of the broken containers. Other, automated procedures within the bath and outside thereof may be employed. Submergible non-frangible ampules are merely cleaned by the process as in the case with floating non-frangible ampules.

From the foregoing, it will be seen that this invention is one well adapted to attain all of the ends and objects hereinabove set forth together with other advantages which are obvious and which are inherent to the apparatus and process.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A process of cleaning and quality control sifting frangible, sealed, partly filled, floatable ampules comprising the steps of:

(1) placing a number of said ampules in a fluid permeable but fully enclosing container having bottom, top and side walls, (2) completely submerging the container with said ampules in an ultrasonic cleaning tank and bath containing sufficient liquid therein to completely cover and fill the container whereby the ampules float therein in physical contact with the container top, (3) transmitting ultrasonic energy into said tank bath in such quantity and in such mode as to both clean the ampules in the container and subject them to sufficient vibrational stress so as to break a substantial percentage of any flawed ampules therein, (4) removing the container with the cleaned and broken ampules from the ultrasonic cleaning tank bath, and (5) separating the cleansed intact ampules and the broken ampules from the container and one another in a subsequent separating step.

2. A process as in claim 1 including the step of placing sufficient ampules in said container prior to placing the latter in the ultrasonic cleaning tank bath to substantially fill the top area thereof when submerged, yet provide but a single thickness layer of ampules therein for cleaning and quality control sifting.

3. A process as in claim 1 including separating the cleaned, intact ampules from the broken such in a second, liquid containing rinse tank in a floatation separating step, wherein the container removed from the ultrasonic cleaning tank bath is placed under the liquid in said second tank with the container top open and the intact ampules are floated out of the upper portion of said container leaving the broken ampules on the container floor.

4. A process as in claim 1 wherein the bottom wall of said container is of solid metal and is positioned in said ultrasonic tank bath at a nodal point in the bath to maximize the energy transmitted into the container in the ultrasonic cleaning process.

5. A process as in claim 4 wherein the top wall of the container is also of solid metal, at least some of the side walls thereof being of metal mesh for filling of the container with the bath liquid.

6. A process as in claim 1 including separating the cleaned, intact ampules from the broken ampules in a second, liquid containing rinse tank in a floatation separating step wherein the said container is removed from the ultrasonic cleaning bath after the cleaning and quality control sifting step and is placed in said second tank under the surface of the liquid therein with the container top and one side wall thereof open and the intact ampules are floated upwardly and out of said container through said open top and side wall to the surface of the liquid in the rinse tank, said second liquid containing tank having means associated therewith for continuously flowing the liquid therewithin from one end of said tank to the other thereof with continuous recirculation of some of the liquid from the latter end back to the former end, there also being provided within said second tank means for collecting said intact ampules released into said tank from said container at the surface of the liquid therein and, further, means for removing said collected ampules from said second tank.

7. A process as in claim 6 wherein said collecting means comprise converging baffles positioned at and below the surface of said liquid in the second tank downstream from said open container positioned in said tank.

8. A process as in claim 6 wherein said means for removing said ampules from said second tank comprises a conveyor belt downstream of said container extending from below the surface of the liquid in said second tank to thereabove, whereby to pickup and remove from the liquid of said second tank ampules at the portion of the surface thereof which contacts said conveyor belt.

9. A process of cleaning sealed, partly filled, floatable ampules comprising the steps of:

(1) placing a number of said ampules in a fluid permeable but fully enclosing container having bottom, top and side walls, (2) completely submerging the container with said ampules in an ultrasonic cleaning tank and bath containing sufficient liquid therein to completely cover and fill the container whereby the ampules float therein in physical contact with the container top, (3) transmitting ultrasonic energy into said tank bath in such quantity and in such mode as to clean the ampules in the container, (4) removing the container with the cleaned ampules from the ultrasonic cleaning tank bath, and (5) removing the cleansed, intact ampules from the container in a subsequent separating step by separating the cleaned ampules from the container in a second, liquid containing rinse tank in a floatation separating step, wherein the container removed from the ultrasonic cleaning tank bath is placed under the liquid in a second tank with the container top open and the ampules are floated out of the upper portion of said container.

10. A process of cleaning sealed, partly filled, floatable ampules comprising the steps of:

(1) placing a number of said ampules in a fluid permeable but fully enclosing container having bottom, top and side walls, (2) completely submerging the container with said ampules in an untrasonic cleaning tank and bath containing sufficient liquid therein to completely cover and fill the container whereby the ampules float therein in physical contact with the container top, (3) transmitting ultrasonic energy into said tank bath in such quantity and in such mode as to clean the ampules in the container, (4) removing the container with the cleaned ampules from the ultrasonic cleaning tank bath and (5) removing the cleansed, intact ampules from the container in a subsequent separating step by separating the cleaned ampules from the container in a second, liquid containing rinse tank in a floatation separating step wherein said container is removed from the ultrasonic cleaning bath after the cleaning step and is placed in the second rinse tank under the surface of the liquid therein with the container top and one side wall thereof open and the ampules are floated upwardly and out of the container through said open top and side wall to the surface of the liquid in the rinse tank, said second, rinse tank having means associated therewith for continuously flowing the liquid therewithin from one end of said tank to the other thereof with continuous recirculation of at least some of the liquid from the latter end back to the former end, there also being provided within said second tank means for collecting said ampules released into said tank from said container at the surface of the liquid therein and, further, means for removing said collected ampules from said second tank.

11. A process of cleaning and quality control sifting frangible, sealed, partly filled, submergible ampules comprising the steps of:

(1) placing a number of said ampules in a fluid permeable but fully enclosing container having bottom, top and side walls, (2) completely submerging the container with said ampules in an ultrasonic cleaning tank and bath containing sufficient liquid therein to completely cover and fill the container, whereby the ampules submerge therein into physical contact with the container bottom, (3) transmitting ultrasonic energy into said tank bath in such quantity and in such mode as to both clean the ampules in the container and subject them to sufficient vibrational stress so as to break a substantial percentage of any flawed ampules therein, (4) removing the container with the cleaned and broken ampules from the ultrasonic cleaning tank bath, and (5) separating the cleansed intact ampules and the broken ampules from the container and one another in a subsequent separating step.

* * * * *